US012060790B2

(12) United States Patent
Fripp et al.

(10) Patent No.: US 12,060,790 B2
(45) Date of Patent: Aug. 13, 2024

(54) USING A RADIOISOTOPE POWER SOURCE IN A DOWNHOLE SENSOR

(71) Applicant: Halliburton Energy Services, Inc., Houston, TX (US)

(72) Inventors: Michael Linley Fripp, Singapore (SG); Jalpan Piyush Dave, Singapore (SG); Joachim Pihl, Sandefjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 17/812,719

(22) Filed: Jul. 14, 2022

(65) Prior Publication Data

US 2023/0184102 A1 Jun. 15, 2023

Related U.S. Application Data

(60) Provisional application No. 63/288,061, filed on Dec. 10, 2021.

(51) Int. Cl.

| | |
|---|---|
| ***E21B 47/135*** | (2012.01) |
| ***E21B 41/00*** | (2006.01) |
| ***E21B 47/18*** | (2012.01) |

(52) U.S. Cl.

CPC ..... *E21B 47/135* (2020.05); *E21B 41/0085* (2013.01); *E21B 47/18* (2013.01)

(58) Field of Classification Search

CPC .... E21B 41/0085; E21B 47/135; E21B 47/14; E21B 47/18

See application file for complete search history.

(56) References Cited

U.S. PATENT DOCUMENTS

| | | | | |
|---|---|---|---|---|
| 4,805,407 | A * | 2/1989 | Buchanan | E21B 41/0085 60/644.1 |
| 7,900,699 | B2 | 3/2011 | Ramos et al. | |
| 8,584,519 | B2 | 11/2013 | Maida et al. | |
| 9,318,680 | B2 * | 4/2016 | Tosi | H10N 10/10 |
| 11,697,978 | B2 * | 7/2023 | Signorelli | H02J 7/0016 166/244.1 |
| 2009/0108192 | A1 | 4/2009 | Groves | |
| 2009/0277629 | A1 | 11/2009 | Mendez et al. | |
| 2013/0061899 | A1 * | 3/2013 | Tosi | E21B 47/07 340/854.6 |

(Continued)

FOREIGN PATENT DOCUMENTS

| | | | | |
|---|---|---|---|---|
| WO | WO-03067029 A1 * | 8/2003 | | E21B 41/0085 |

OTHER PUBLICATIONS

Olsen, Larry C. "Review of Betavoltaic Energy Conversion," Washington State University, retrieved at http://large.stanford.edu/courses/2013/ph241/harrison2/docs, 2013, 12 pages.

(Continued)

*Primary Examiner* — Jennifer H Gay

(74) *Attorney, Agent, or Firm* — Kilpatrick Townsend & Stockton LLP

(57) ABSTRACT

A system comprising a sensor device to perform measurements in a wellbore. The system may also include a wireless transmitter to transmit a signal representing the measurements to a wired transmission system. The wired transmission system may transmit the signal to an interrogation system. A radioisotope power source may provide electrical power to the sensor system in the wellbore.

20 Claims, 6 Drawing Sheets

(56) References Cited

U.S. PATENT DOCUMENTS

| | | | | |
|---|---|---|---|---|
| 2015/0330214 | A1 | 11/2015 | Duphorne | |
| 2016/0245047 | A1* | 8/2016 | Tosi | E21B 49/08 |
| 2018/0136354 | A1* | 5/2018 | Haldorsen | G01V 11/005 |
| 2018/0320509 | A1* | 11/2018 | Skinner | G01V 3/26 |
| 2018/0328120 | A1* | 11/2018 | Therrien | E21B 43/119 |
| 2020/0095847 | A1* | 3/2020 | Signorelli | H01G 11/62 |
| 2023/0184102 | A1* | 6/2023 | Fripp | E21B 47/01 175/40 |

OTHER PUBLICATIONS

International Search Report and Written Opinion, PCT/US2022/8073752, Nov. 3, 2022, 10 Pages.

* cited by examiner

USING A RADIOISOTOPE POWER SOURCE IN A DOWNHOLE SENSOR

CROSS REFERENCE TO RELATED APPLICATION

This claims priority to U.S. Application No. 63/288,061, titled "Using a Radioisotope Power Source in a Downhole Sensor" and filed Dec. 10, 2021, the entirety of which is incorporated herein by reference.

TECHNICAL FIELD

The present disclosure relates generally to wellbore operations and, more particularly (although not necessarily exclusively), to power sources for tools in a wellbore.

BACKGROUND

Hydrocarbons, such as oil and gas, can be extracted from subterranean formations that may be located onshore or offshore. Hydrocarbons can be extracted through a wellbore formed in a subterranean formation. Wellbore operations for extracting hydrocarbons can include drilling operations, completion operations, production operations, and the like.

Wellbore operations may employ the use of sensors placed downhole, below a surface. The sensors may measure a variety of conditions, such as pressure, temperature, acoustic vibration, fluid composition, flow rate, or wellbore casing strain.

DETAILED DESCRIPTION

Figure 1:
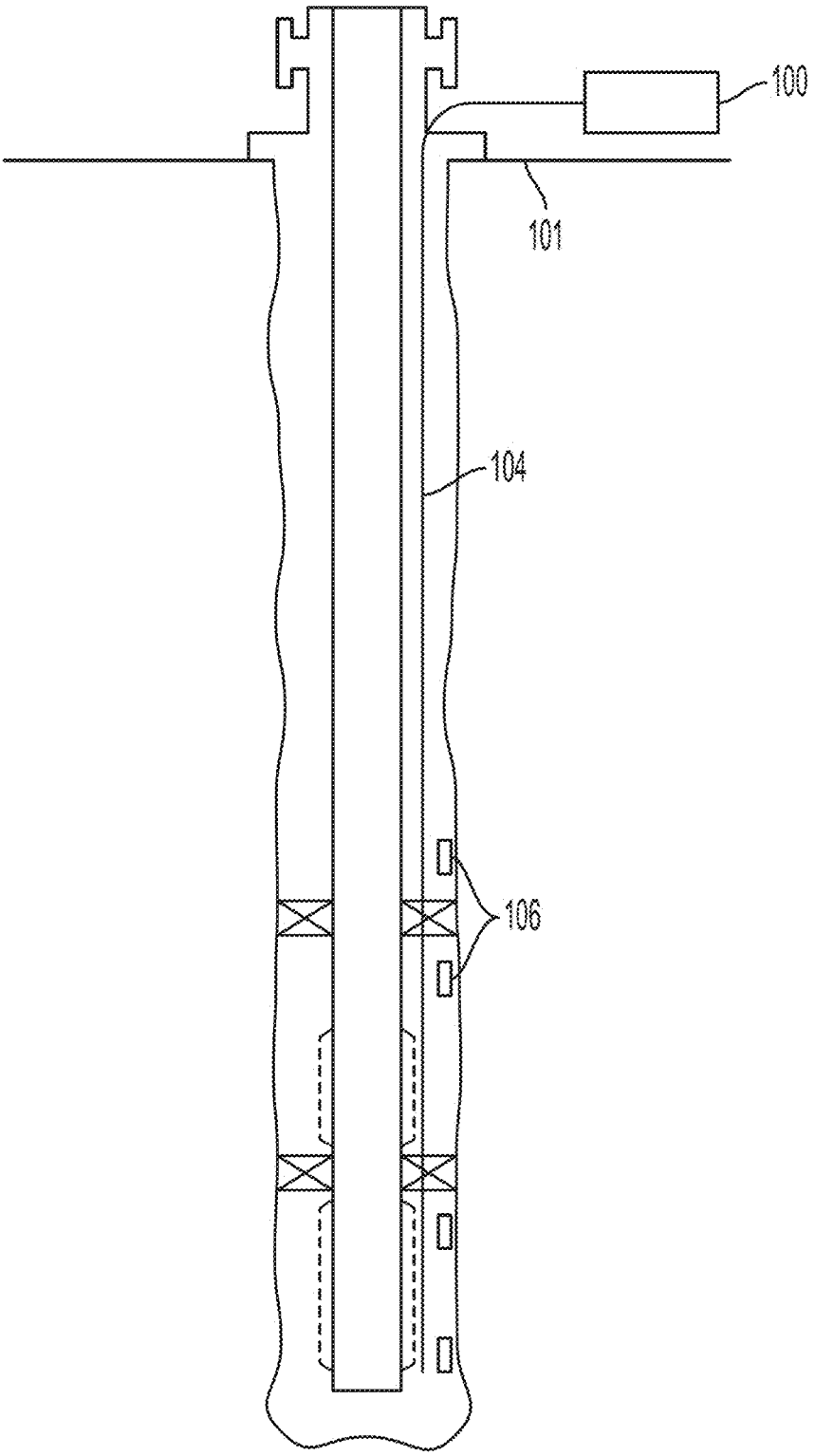
FIG. 1 is a cross sectional view of an example of a well system that may include a radioisotope power supply according to some aspects of the present disclosure.

Certain aspects and examples of the present disclosure relate to using a radioisotope power source to provide electrical power for a sensor downhole in a wellbore. The radioisotope power source may generate an electrical current from particles emitted via radioactive decay into a semiconductor junction. The radioisotope power source may offer a long service life, sometimes in the span of years or decades, without a need for refueling or recharging, for low-voltage applications.

Low power electrical sensors may offer greater accuracy and a wider range of sensed parameters than distributed fiber optic sensors. Powering the low power electrical sensors for multi-year service can present challenges. Batteries can self-discharge. Turbine power generators may have limited placement options. In contrast, the radioisotope power source may have a longer service life and may have a smaller displacement to mitigate the respective challenges presented by batteries and turbines.

A radioisotope power source, according to some examples, may provide electrical power for a short wireless connection between a sensor module that includes an electrical sensor and a transmission line that may receive sensor data. Examples of the transmission line can include an optical waveguide such as an optical fiber cable, a tubing encased conductor, a telemetry hub, or a wired pipe.

The electrical sensor can be more varied and more accurate than fiber optic sensors such as Distributed Acoustic Sensing (DAS) or Distributed Temperature Sensing (DTS) sensors. For example, fiber optic sensors reliant on DAS or DTS may be limited to sensing qualities such as vibration or strain that can cause reverberations in a glass core of an optical cable. An example electrical sensor capable of analyzing fluid composition may not be able to transmit measurements without a potentially costly and invasive process of patching into a power line or installing a turbine. The example electrical sensor can transmit measurements along an optical cable, without patching into the optical cable, by acoustic vibrations. The radioisotope power source can act as the power source for creating the acoustic vibrations. In examples where the voltage provided by the radioisotope power source is too low to actuate the acoustic vibrations, an energy storage device can store electrical energy generated by the radioisotope power source, allowing the sensor to transmit when sufficient electrical energy to actuate the acoustic vibrations has been stored. An alternative, non-invasive example may also involve any suitable sensor wirelessly transmitting an electromagnetic signal into an existing wired, electromagnetic transmission system without patching into the wired electromagnetic transmission system. Instead of transmitting acoustic vibrations, the sensor may use a wireless electromagnetic transmitter, such as a solenoid or a ferrite ring surrounding the wired transmission system, to transmit a signal into the wired electromagnetic transmission system. Example electromagnetic transmission systems include a tubing encased conductor or at least one copper cable.

The radioisotope power source can enable the sensor module to communicate over the transmission line for a service life of years or even decades. The service life that may be afforded by the radioisotope power source may allow for higher quality data, a wider range of data, and more precise data to be gathered by the electrical sensor, from a downhole environment. Also, the sensor module, powered by the radioisotope power source, can be added to any fiber optic installation without breaking the optical waveguide and without risking the integrity of the optical waveguide.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross sectional view of an example of a well system that may include a radioisotope power supply according to some aspects of the present disclosure. The radioisotope power supply can be positioned within or proximal to a sensor module 106. The sensor module 106 may also include a sensor, a processor, or a transmitter. The radioisotope power supply may provide long-life power to the sensor module 106. FIG. 1 also illustrates an interrogation system 100 that may be above a surface 101, communicatively coupled to a fiber optic cable 104. In some examples, the fiber optic cable 104 may be replaced by another type of optical waveguide or an electromagnetic transmission device. Examples of optical waveguides include, but are not limited to, multiple optical fibers, or at least one optical ribbon. Optical waveguides may be single mode waveguides, multi-mode waveguides, or a combination of single mode and multi-mode waveguides. Examples of electromagnetic transmission devices include tubing encased conductors, wired pipes, dipole antennas, or coiled inductors.

The sensor module 106 can take measurements via the sensor. Examples of measurements include, but are not limited to, pressure, temperature, acoustic vibration, fluid composition, static strain, dynamic strain, flow rate, tool passage, tool operation, tool health, magnetic flux, electrical field, or gravitational acceleration.

The sensor module 106 may create an acoustic signal representing the measurements. The acoustic signal may create vibrations in the fiber optic cable 104. The vibrations may be transmitted wirelessly to the fiber optic cable 104, from the transmitter. Alternatively, the vibrations may be transmitted with the transmitter in direct contract with the fiber optic cable 104. Examples of actuators the transmitter may possess include solid-state actuators such as piezoceramic, piezo-polymer, magnetostriction-based, or electrostriction-based actuators. Alternatively, electromagnetic signals may be transmitted into an electromagnetic transmission device in place of the fiber optic cable. Examples of actuators the transmitter may possess include electromagnetic actuators such as voice coils, solenoids, or vibration motors. These examples are not meant to be limiting and other examples may be possible.

The vibrations may be detected by the interrogation system 100. The interrogation system 100 may use laser light to take measurements along the fiber optic cable 104. The interrogation system 100 may contain one or more lasers, interferometers, photodetectors, optical dime domain reflectors, or other optical equipment. The interrogation system 100 may detect Brillouin backscatter gain or may detect coherent Rayleigh backscatter that may result from the vibrations within the fiber optic cable 104. Detection of Rayleigh backscatter may allow the interrogation system 100 to monitor dynamic strain via vibrations of the fiber optic cable 104, without the need for the digital signal produced by the transmitter. A Rayleigh scattering based distributed acoustic sensing capability of the fiber optic cable 104 may allow detecting of digital signal from the sensor measurement. Raman backscatter may also be detected and, if used in conjunction with detection of Brillouin backscatter, may be used for thermally calibrating Brillouin backscatter detection data. A Brillouin backscatter detection technique may use a natural acoustic velocity via a corresponding scattered photon frequency shift in the fiber optic cable 104, or in any other waveguide, at a given location along the fiber optic cable 104, or any other waveguide.

Figure 2:
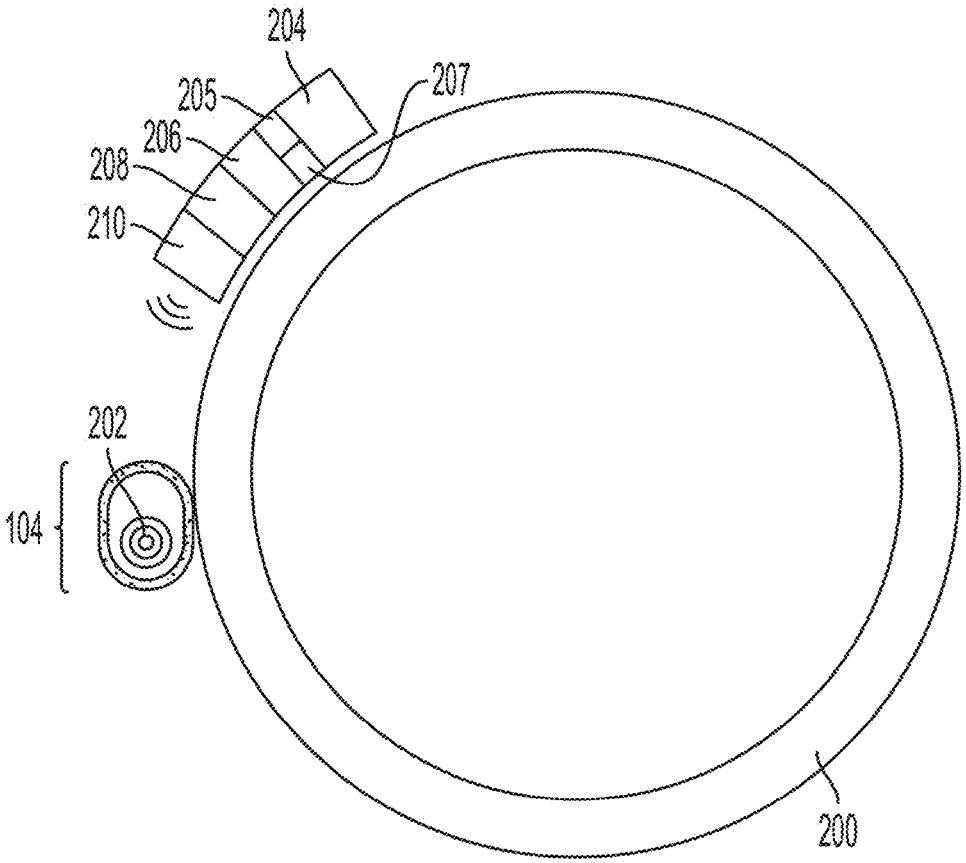
FIG. 2 is a schematic top view of an example of the sensor module in communication with the fiber optic cable according to some aspects of the present disclosure.

FIG. 2 is a schematic top view of an example of the sensor module 106 in communication with the fiber optic cable 104 according to some aspects of the present disclosure. The sensor module 106 is located proximal to a production tubing 200. The sensor module 106 contains a radioisotope power supply 204, a power supply controller 205, an energy storage device 207, sensor 206, a processor 208, and a wireless transmitter 210. The fiber optic cable 104 is also located proximal to the production tubing 200. A glass core 202 is inside the fiber optic cable 104.

The wireless transmitter 210 of the sensor module 106 can transmit an acoustic signal wirelessly to the fiber optic cable 104. In alternative examples, the wireless transmitter 210 may transmit the acoustic signal to the fiber optic cable 104 through direct physical contact. The acoustic signal may create vibrations that may result from the acoustic signal reverberating off the glass core 202 of the fiber optic cable 104.

The energy storage device 207 may store electrical energy from the radioisotope power supply 204. The power supply controller 205 may release energy from the energy storage device 207 to amplify a signal representing measurements obtained by the sensor 206. The signal may be wirelessly transmitted by the wireless transmitter 210 in response to the power supply controller 205 determining the energy storage device 107 has stored enough electrical energy to effectively transmit the signal. The energy storage device 207 may include at least one capacitor, at least one supercapacitor, or at least one chemical battery. The energy storage device 207 may include at least one charge pump.

The processor 208 may convert measurements into a digital signal. The digital signal may include at least one of the measurements and may include additional information such as a location address, a time stamp, a data packet header, or a checksum value that may represent a number of bits within the data signal. The processor may create an acoustic output of the digital signal, via the wireless transmitter 210.

The processor 208 may allow a wider range of instruments to be used as the sensor 206. Instruments reliant on Distributed Acoustic Sensing (DAS) or Distributed Temperature Sensing (DTS) effects on an optical waveguide may be limited in the types of measurements the instrument can take. An example in which the processor 208 provides an advantage may be a scenario wherein the sensor 206 is a fluid composition sensor that may only be capable of outputting an electrical signal to represent its measurement. The processor 208 may convert the signal of the example chemical sensor to an acoustic output that can be transmitted along an optical waveguide.

Figure 3:
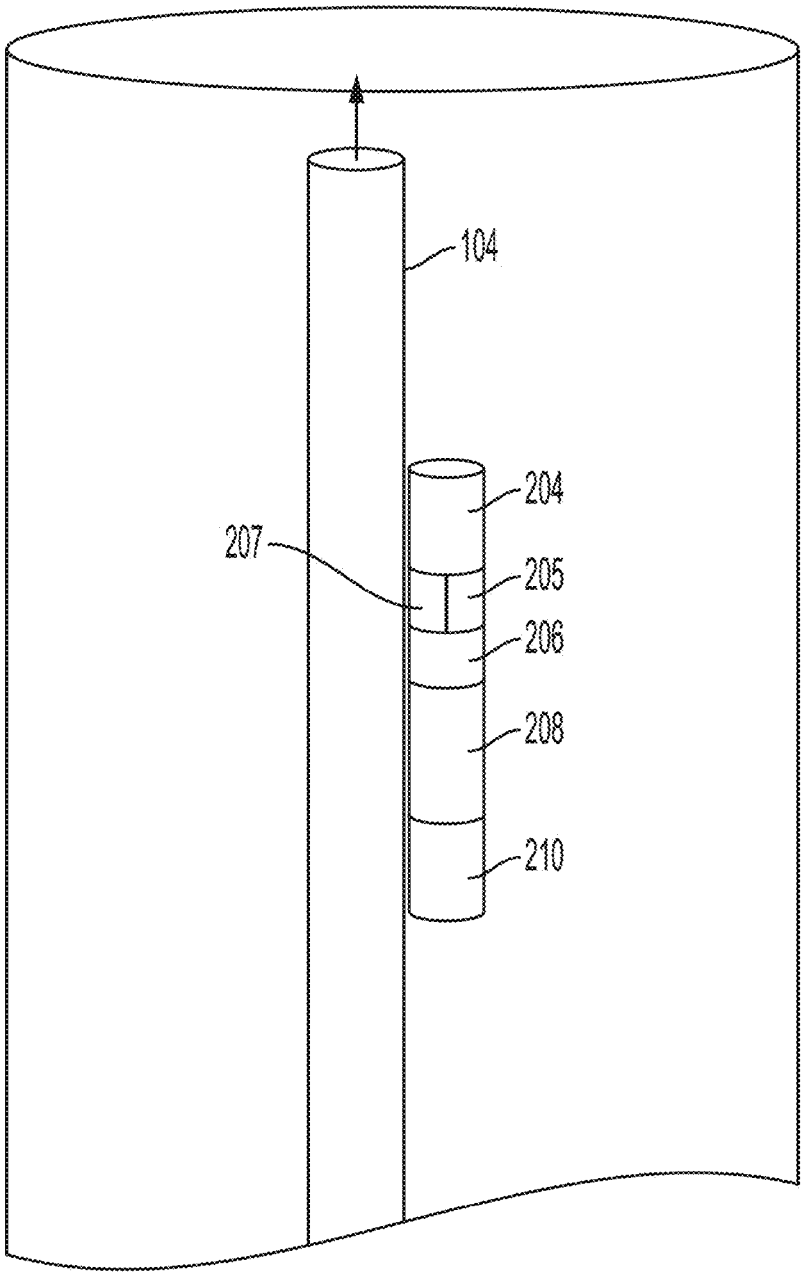
FIG. 3 is a schematic side view of the wireless transmitter in direct contact with the optical waveguide with respect to production tubing according to some aspects of the present disclosure.

FIG. 3 is a schematic side view of the wireless transmitter 210 in direct contact with the fiber optic cable 104 with respect to production tubing 200 according to some aspects of the present disclosure. The wireless transmitter 210 can emit an acoustic signal into the fiber optic cable 104. The acoustic signal can create vibrations that may result from the acoustic signal reverberating off the glass core 202 of the fiber optic cable 104.

The radioisotope power supply 204 may include a tritium source, a semiconductor, and at least one capacitor, at least one supercapacitor, or at least one battery. Within the semiconductor there can be a p-type region, an n-type region, electrons, and electron-holes. Particles emitted within the radioisotope power supply may generate excitons (bound electron-hole pairs), unbound electron-hole pairs (via excitons) or plasmons within the semiconductor.

The tritium source can emit beta particles into the semiconductor. When the semiconductor is excited by beta particles, pairs of electrons and electron holes can be generated by impact ionization. In other examples, radioisotopes, including but not limited to isotopes of promethium, hydrogen, and nickel, may emit beta particles in place of the tritium source. In other examples, radioisotopes may include isotopes of americium, polonium, and bismuth, in place of the tritium source, to emit alpha particles in place of the beta particles. Alpha particles may also generate pairs of electrons and electron holes by impact ionization.

Electrons can be produced within the n-type region and can move towards the p-type region. Electron holes can be produced within the p-type region and can move towards the n-type region. The electrons and electron holes moving can result in a current that can flow through a load. Examples of the load may include electronics within the sensor module 106, such as the sensor 206, the processor 208, the power supply controller 205, the energy storage device 207, and the wireless transmitter 210. The energy storage device 207 may be arranged to provide energy at times of higher energy demand, such as producing telemetry signals via the sensor 206.

In some examples, the semiconductor may be a single layer within the radioisotope power supply 204. In other examples, the semiconductor may be one of multiple layers of semiconductors within the radioisotope power supply 204. Banks of multiple layers of semiconductors, with the layers arranged in either series or parallel, may be arranged in series or parallel with other banks so that a desired voltage or current output of the radioisotope power supply 204 can be achieved.

A voltage produced by the semiconductor can depend on the material composition of the semiconductor. Example materials for the semiconductor include, but are not limited to, Aluminum phosphide, Aluminum arsenide, Copper Oxide, Tin Oxide, Germanium, Silicon, Gallium, Gallium Phosphide, Gallium Selenide, Carbon, Uranium, Boron, Silicon Germanium, Silicon Carbide, Barium Sulfide, Boron Arsenide, Boron Nitride, Gallium Nitride, Gallium Arsenide, Gallium Antimonite, Cadmium Telluride, Cadmium sulfide, Zinc oxide, Zinc Selenide, Zinc Sulfide, Zinc Telluride or Uranium Oxide. The semiconductor may be a wide-bandgap semiconductor.

Figure 4:
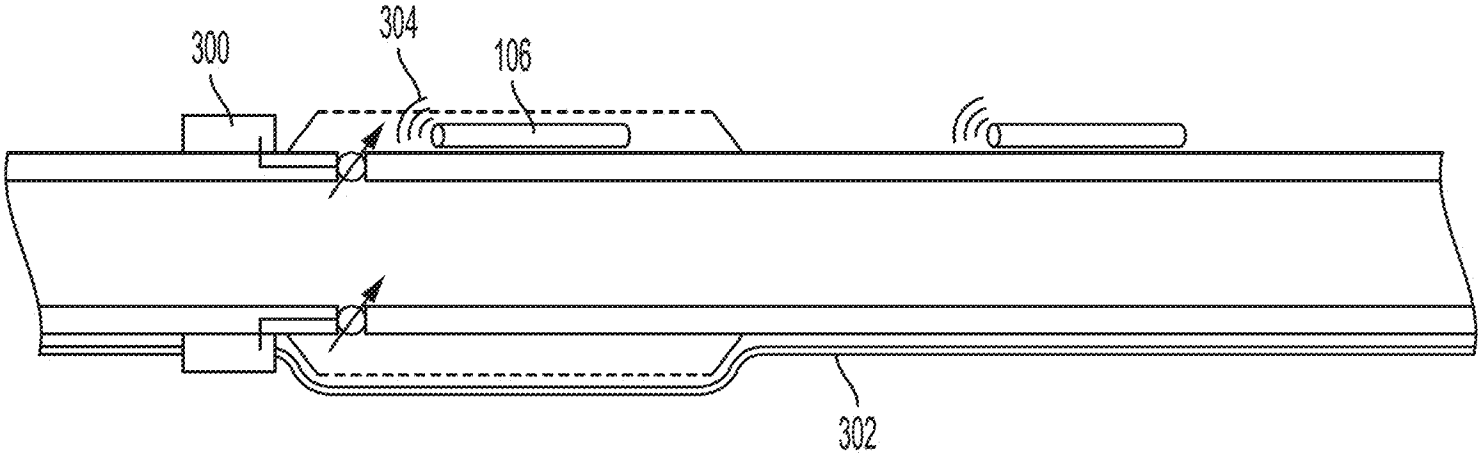
FIG. 4 is a schematic side view of the sensor module transmitting an acoustic signal to a receiver proximal to an inflow control valve according to some aspects of the present disclosure.

FIG. 4 is a schematic side view of the sensor module 106 transmitting an acoustic signal 304 to a receiver proximal to an inflow control valve 300 according to some aspects of the present disclosure. The sensor module 106 may transmit acoustic signals 304 via the wireless transmitter 210 that may consist of digital information related to measurements gathered by the sensor 206. The receiver proximal to the inflow control valve 300 may encode the digital information within the acoustic signal 304 as an electromagnetic signal. The tubing encased conductor 302 may then send the digital information to the interrogation system 100. Alternatives to the tubing encased conductor 302 include, but are not limited to, a wired pipe, a dipole antenna, a coiled inductor, or any other means of conveying an electromagnetic signal.

The inflow control valve 300 may be actuated in response to the acoustic signal 304. The acoustic signal 304 may contain instructions for the inflow control valve 300 or the inflow control valve 300 may determine how to actuate based on sensor data contained within the acoustic signal 304. In place of the inflow control valve 300, other downhole tools may actuate in response to sensor data. In some such examples, downhole tools may respond to the acoustic signal 304 faster than instructions that originate from a surface and are generated in response to sensor data that travelled from downhole to the surface. In some examples, downhole tools such as the inflow control valve 300 may also receive electromagnetic signals in place of the acoustic signal 304.

Figure 5:
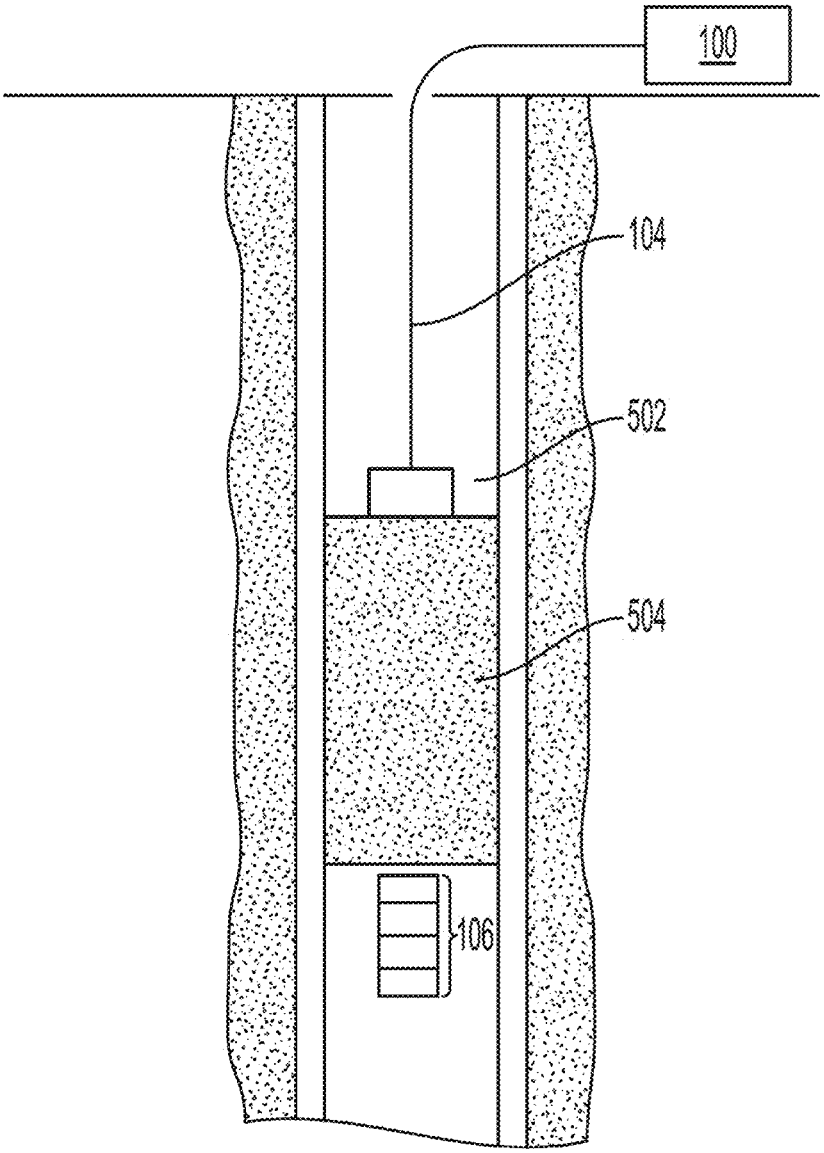
FIG. 5 is a schematic side view of the sensor module for transmitting sensor data across a cement plug according to some aspects of the present disclosure.

FIG. 5 is a schematic side view of the sensor module 106 for transmitting sensor data across a cement plug 504 according to some aspects of the present disclosure. The cement plug 504 may be placed in a plug-and-abandonment scenario. A receiver 502 may gather measurements from the sensor module 106. The measurements are communicated across a communication cable 506, such as a TEC, wireline, or a fiber optic cable, to the interrogation system 100. A radioisotope power supply within the sensor module 106 may be useful for its extended lifespan in the plug-and-abandonment scenario.

Figure 6:
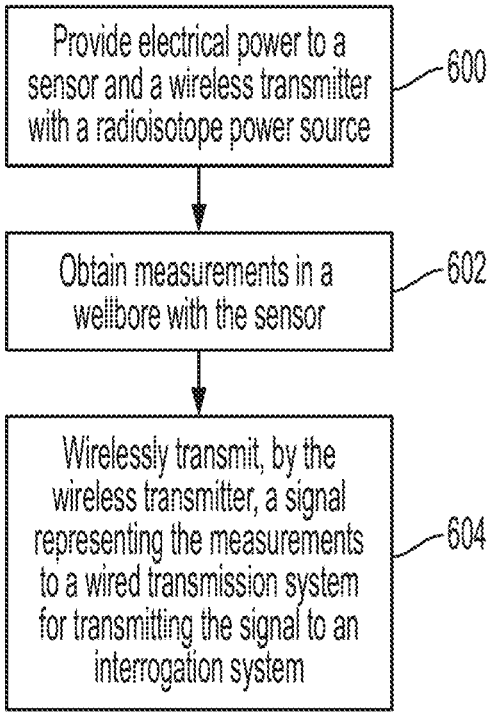
FIG. 6 is a flowchart of a process for transmitting a signal representing sensor data according to some aspects of the present disclosure.

FIG. 6 is a flowchart of a process for transmitting a signal representing sensor data according to some aspects of the present disclosure. In block 600 a radioisotope power supply 204 may provide electrical power to a sensor 206 and a wireless transmitter 210. The radioisotope power supply 204 may provide electrical power by emitting particles into a semiconductor junction. The type of particles emitted into the semiconductor junction may depend on a radioactive isotope within the radioisotope power supply 204. In some examples, uranium or plutonium waste from a nuclear reactor may be used as a source of alpha particles. In some examples, tritium may be used as a source of beta particles. In some examples, nickel-63 or carbon-14 may be used as a source of beta particles emitted into a diamond semiconductor. Other possible radioactive isotopes include promethium-147, technetium-99, plutonium-238, curium-242, curium-244, and strontium-90. In some examples, neutron emitting isotopes such as beryllium-13 may emit neutrons into a semiconductor junction. In some examples, the radioisotope power supply 204 may be a nuclear batter based on hydride/thorium fuel.

Electrical power from the radioisotope power supply 204 may be stored in an energy storage device 207, such as a capacitor, supercapacitor, or a chemical battery. Storage and release of the electrical power may be controlled by a power supply controller 205.

The wireless transmitter 210 may include an actuator to affect an optical waveguide. Examples of actuators the wireless transmitter 210 may possess include solid state, ferroelectric actuators such as piezoceramic, piezopolymer, or electrostriction actuators. Other examples of actuators the wireless transmitter 210 may possess include electromagnetic actuators such as voice coils, solenoids, or vibration motors. The wireless transmitter 210 may include an actuator to affect an electrically conductive transmission line. Examples of actuators to affect an electrically conductive transmission line may include an oscillator and a modulator to produce a radio-frequency signal or a coiled inductor or solenoid to produce a varying magnetic field as a signal.

In block 602, the sensor 206 may obtain measurements from a wellbore. Examples of measurements include, but are not limited to, pressure, temperature, acoustic vibration, fluid composition, static strain, dynamic strain, flow rate, tool passage, tool operation, tool health, magnetic flux, electrical field, or gravitational acceleration. Measurements may be converted into a signal representing the measurements by a processor 208 within the sensor module 106. The signal representing the measurements may be converted, by the processor 208, to a digital signal by quantizing amplitudes comprising an original signal and assigning the values of the quantized amplitudes to regular time intervals. The processor 208 may include instructions for downhole tools within the signal representing the measurements. The instructions for downhole tools may be based on the measurements.

In block 604, the wireless transmitter may wirelessly transmit the signal representing the measurements to a wired transmission system. The signal may be wirelessly transmitted in response to the power supply controller 205 determining the energy storage device 207 has stored enough electrical energy to effectively transmit the signal.

The wired transmission system may be an optical waveguide. Examples of optical waveguides include, but are not limited to, multiple optical fibers, or at least one optical ribbon. Optical waveguides may be single mode waveguides, multi-mode waveguides, or a combination of single mode and multi-mode waveguides. The wired transmission system may be an electromagnetic transmission device. Examples of electromagnetic transmission devices include tubing encased conductors, wired pipes, dipole antennas, or coiled inductors. In some examples the actuator of the wireless transmission system may impart acoustic waves or electromagnetic waves through a medium, such as a cement plug, to transmit the signal representing the measurements to the wired transmission system.

The signal representing the measurements may be transmitted along the wired transmission system to an interrogation system. The interrogation system may interpret an optical signal from an optical waveguide. The interrogation system may interpret an analog or digital electromagnetic signal. The interrogation system may be communicatively coupled or may contain a computing device. The computing device may contain a processor, a memory, and instructions to interpret the signal.

In some aspects, systems and methods for the radioisotope power source are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a sensor system comprising: a sensor device to perform measurements in a wellbore; a wireless transmitter to transmit a signal representing the measurements to a wired transmission system for transmitting the signal to an interrogation system; and a radioisotope power source to provide electrical power to the sensor system in the wellbore.

Example 2 is the sensor system of example(s) 1, wherein the radioisotope power source is a tritium power source.

Example 3 is the sensor system of example(s) 1, wherein the wireless transmitter includes or is coupled to an acoustical vibrator to transmit the signal via a fiber optic cable by creating vibrations representing the signal in the fiber optic cable and the wired transmission system is the fiber optic cable.

Example 4 is the sensor system of example(s) 1, further comprising a processing device configured to convert the measurements into a digital signal for transmitting to the interrogation system.

Example 5 is the sensor system of example(s) 1, further comprising an energy storage device for storing electrical energy from the radioisotope power source.

Example 6 is the sensor system of example(s) 5, further comprising a power supply controller for releasing the electrical energy from the energy storage device to amplify the signal representing the measurements in response to determining that sufficient energy for a transmission signal is stored.

Example 7 is the sensor system of example(s) 1, further comprising a processing device configured to convert the measurements from an electromagnetic signal into an optical signal for transmitting to the interrogation system.

Example 8 is a system comprising: a wired transmission system; an interrogation system communicable with the wired transmission system for receiving a signal and detecting measurements from the signal; and a sensor subsystem comprising: a sensor device to receive the measurements in a wellbore; a wireless transmitter to transmit the signal representing the measurements to the wired transmission system for transmitting the signal to the interrogation system; and a radioisotope power source to provide electrical power to the sensor subsystem in the wellbore.

Example 9 is the system of example(s) 8, wherein the radioisotope power source is a tritium power source.

Example 10 is the system of example(s) 8, wherein the wireless transmitter includes or is coupled to an acoustical vibrator to transmit the signal via a fiber optic cable by creating vibrations representing the signal in the fiber optic cable and the wired transmission system is the fiber optic cable.

Example 11 is the system of example(s) 8, further comprising a processing device configured to convert the measurements into a digital signal for transmitting to the interrogation system.

Example 12 is the system of example(s) 8, further comprising an energy storage device for storing electrical energy from the radioisotope power source.

Example 13 is the system of example(s) 12, further comprising a power supply controller for releasing the electrical energy from the energy storage device to amplify the signal representing the measurements in response to determining that sufficient energy for a transmission signal is stored.

Example 14 is the system of example(s) 8, further comprising a processing device configured to convert the measurements from an electromagnetic signal into an optical signal for transmitting to the interrogation system.

Example 15 is a method comprising: providing electrical power to a sensor and a wireless transmitter with a radioisotope power source; obtaining measurements in a wellbore with the sensor; and wirelessly transmitting, by the wireless transmitter, a signal representing the measurements to a wired transmission system for transmitting the signal to an interrogation system.

Example 16 is the method of example(s) 15, wherein the radioisotope power source is a tritium power source.

Example 17 is the method of example(s) 15, wherein the wireless transmitter includes or is coupled to an acoustical vibrator to transmit the signal via a fiber optic cable by creating vibrations representing the signal in the fiber optic cable and the wired transmission system is the fiber optic cable.

Example 18 is the method of example(s) 15, further comprising converting the measurements, with a processing device, into a digital signal for transmitting to the interrogation system.

Example 19 is the method of example(s) 15, further comprising storing electrical energy from the radioisotope power source with an energy storage device.

Example 20 is the method of example(s) 19, further comprising releasing the electrical energy from the energy storage device to amplify the signal representing the measurements in response to determining that sufficient energy for a transmission signal is stored.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A sensor system comprising:

a sensor device to perform measurements in a wellbore;

a wireless transmitter to transmit a signal representing the measurements to a wired transmission system for transmitting the signal to an interrogation system;

a radioisotope power source to provide electrical power to the sensor system in the wellbore;

an energy storage device for storing electrical energy from the radioisotope power source; and a power supply controller for releasing the electrical energy from the energy storage device to amplify the signal representing the measurements in response to determining that sufficient energy for a transmission signal is stored in the energy storage device.

2. The sensor system of claim 1, wherein the radioisotope power source is a tritium power source.

3. The sensor system of claim 1, wherein the wireless transmitter includes or is coupled to an acoustical vibrator to transmit the signal via a fiber optic cable by creating vibrations representing the signal in the fiber optic cable and the wired transmission system is the fiber optic cable.

4. The sensor system of claim 1, further comprising a processing device configured to convert the measurements into a digital signal for transmitting to the interrogation system.

5. The sensor system of claim 4, wherein the processing device is configured to convert electrical signals representing the measurements into a digital signal for transmitting to the interrogation system.

6. The sensor system of claim 1, wherein the energy storage device is selected from the group consisting of at least one capacitor, at least one supercapacitor, at least one chemical battery, and at least one charge pump.

7. The sensor system of claim 1, further comprising a processing device configured to convert the measurements from an electromagnetic signal into an optical signal for transmitting to the interrogation system.

8. A system comprising:

a wired transmission system;

an interrogation system communicable with the wired transmission system for receiving a signal and detecting measurements from the signal; and a sensor subsystem comprising:

a sensor device to receive the measurements in a wellbore;

a wireless transmitter to transmit the signal representing the measurements to the wired transmission system for transmitting the signal to the interrogation system;

a radioisotope power source to provide electrical power to the sensor subsystem in the wellbore;

an energy storage device for storing electrical energy from the radioisotope power source; and a power supply controller for releasing the electrical energy from the energy storage device to amplify the signal representing the measurements in response to determining that sufficient energy for a transmission signal is stored in the energy storage device.

9. The system of claim 8, wherein the radioisotope power source is a tritium power source.

10. The system of claim 8, wherein the wireless transmitter includes or is coupled to an acoustical vibrator to transmit the signal via a fiber optic cable by creating vibrations representing the signal in the fiber optic cable and the wired transmission system is the fiber optic cable.

11. The system of claim 8, further comprising a processing device configured to convert the measurements into a digital signal for transmitting to the interrogation system.

12. The system of claim 11, wherein the processing device is configured to convert electrical signals representing the measurements into a digital signal for transmitting to the interrogation system.

13. The system of claim 8, wherein the energy storage device is selected from the group consisting of at least one capacitor, at least one supercapacitor, at least one chemical battery, and at least one charge pump.

14. The system of claim 8, further comprising a processing device configured to convert the measurements from an electromagnetic signal into an optical signal for transmitting to the interrogation system.

15. A method comprising:

providing electrical power to a sensor and a wireless transmitter with a radioisotope power source;

storing electrical energy from the radioisotope power source with an energy storage device;

obtaining measurements in a wellbore with the sensor; and wirelessly transmitting, by the wireless transmitter, a signal representing the measurements to a wired transmission system for transmitting the signal to an interrogation system by releasing the electrical energy from the energy storage device to amplify the signal in response to determining that sufficient energy for a transmission signal is stored in the energy storage device.

16. The method of claim 15, wherein the radioisotope power source is a tritium power source.

17. The method of claim 15, wherein the wireless transmitter includes or is coupled to an acoustical vibrator to transmit the signal via a fiber optic cable by creating vibrations representing the signal in the fiber optic cable and the wired transmission system is the fiber optic cable.

18. The method of claim 15, further comprising converting the measurements, with a processing device, into a digital signal for transmitting to the interrogation system.

19. The method of claim 18, wherein the processing device converts electrical signals representing the measurements into a digital signal for transmitting to the interrogation system.

20. The method of claim 15, wherein the energy storage device is selected from the group consisting of at least one capacitor, at least one supercapacitor, at least one chemical battery, and at least one charge pump.

* * * * *